US005151136A

United States Patent [19]

Witters et al.

[11] Patent Number: 5,151,136

[45] Date of Patent: Sep. 29, 1992

[54] LOW ASPECT RATIO LITHIUM-CONTAINING ALUMINUM EXTRUSIONS

[75] Inventors: Jeffrey J. Witters, Pittsburgh, Pa.; Brian A. Cheney, Bettendorf, Iowa; Roberto J. Rioja, Lower Burrell, Pa.

[73] Assignee: Aluminum Company of America, Pittsburgh, Pa.

[21] Appl. No.: 634,901

[22] Filed: Dec. 27, 1990

[51] Int. Cl.[5] ..... C22F 1/04

[52] U.S. Cl. ..... 148/689; 148/415; 148/418; 148/439; 72/364

[58] Field of Search ..... 148/11.5 A, 12.7 A, 148/159, 415, 418, 439; 420/528, 532

[56] References Cited

U.S. PATENT DOCUMENTS 4,869,870 9/1989 Rioja et al. ..... 420/532

FOREIGN PATENT DOCUMENTS 60-023189 6/1985 Japan ..... 148/11.5 A

*Primary Examiner*—R. Dean
*Assistant Examiner*—Robert R. Koehler
*Attorney, Agent, or Firm*—Andrew Alexander

[57] ABSTRACT

Disclosed is a method of making lithium-containing aluminum base alloy extrusion having at least a section thereof having a low aspect ratio, the extrusions having improved properties in sections thereof having the low aspect ratio. The method comprises providing a body of a lithium-containing aluminum alloy, extruding a low aspect ratio extrusion section, the aspect ratio being in the range of 1 to 2.5, and maintaining the body in a temperature range of 400° to 1000° F. and at least a 4:1 extrusion reduction during said extrusion step, the extrusion section having tensile yield strength of at least 60 ksi and having an ultimate yield strength of at least 4.5 ksi greater than the tensile yield strength.

19 Claims, 1 Drawing Sheet

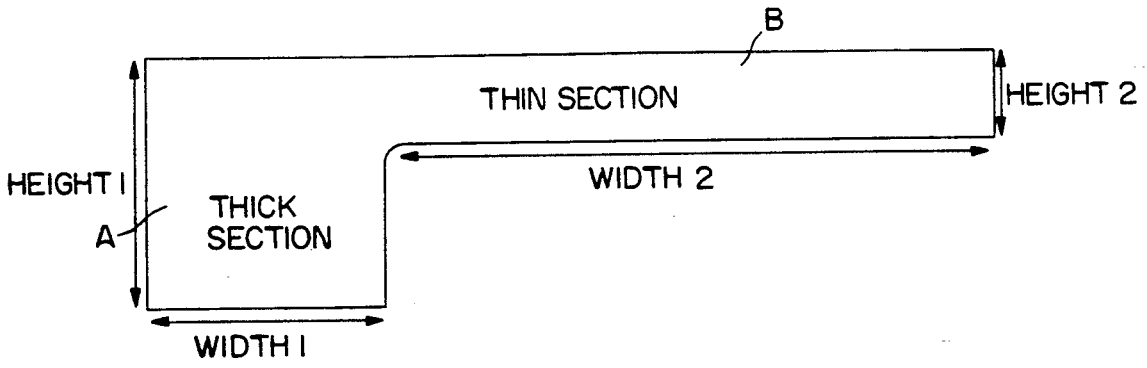
FIG. I
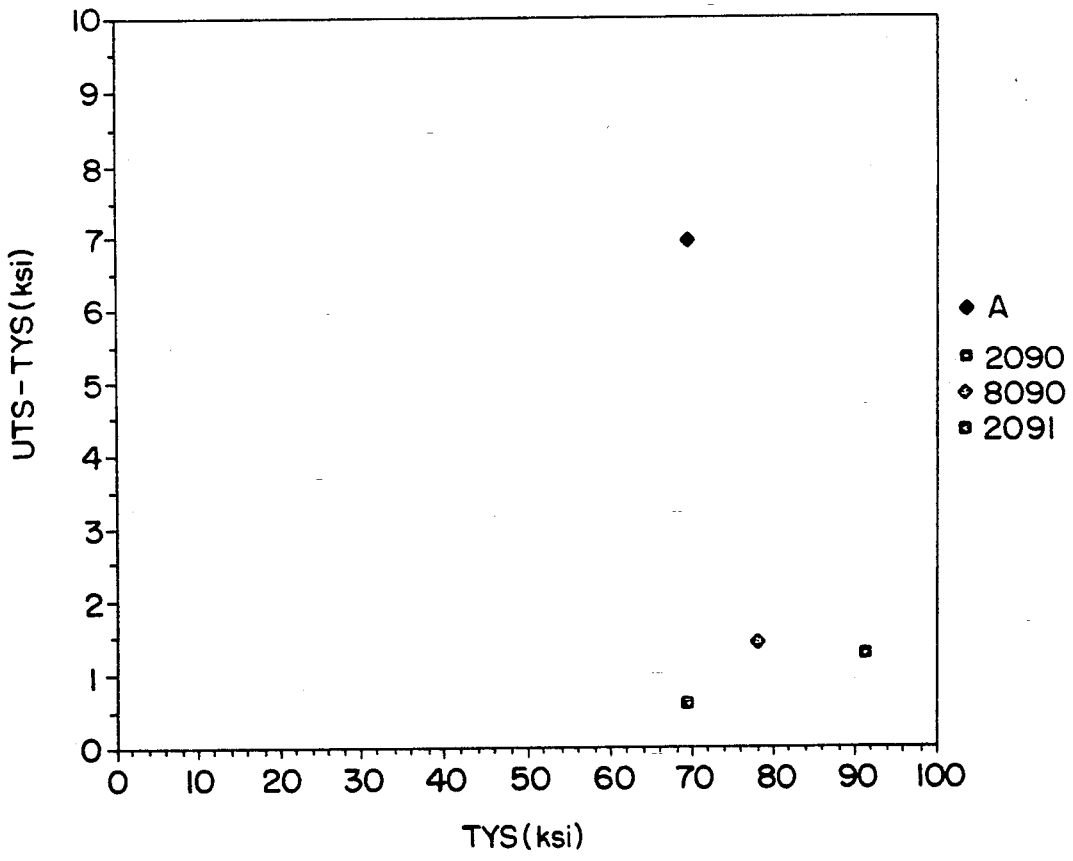
FIG. 2

LOW ASPECT RATIO LITHIUM-CONTAINING ALUMINUM EXTRUSIONS

INTRODUCTION

This invention relates to extrusions and more particularly it relates to lithium-containing aluminum base alloy extrusions having improved properties.

In the aircraft industry, it has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, in aluminum-lithium alloy extrusions having sections thereof having low aspect ratios, it has been found that the low aspect ratio sections can have inferior properties to sections having high aspect ratios. Thus, the use of such extrusions can be severely limited by the inferior properties in the section having the low aspect ratio.

The present invention provides an extrusion wherein the section having the low aspect ratio has improved properties.

SUMMARY OF THE INVENTION

An object of this invention is to provide an improved lithium-containing aluminum base alloy extrusion.

Another object of this invention is to provide lithium-containing aluminum base alloy extrusion having low aspect ratio sections thereof having improved properties.

A further object of this invention is to provide a lithium-containing aluminum base alloy extrusion having low aspect ratio sections (2.5:1 or less) having tensile yield strength greater than 60 ksi and having an ultimate yield strength of at least 4.5 ksi greater than the tensile strength.

These and other objects will become apparent from the specification, drawings and claims appended hereto.

Disclosed is a method of making lithium-containing aluminum base alloy extrusion having at least a section thereof having a low aspect ratio, the extrusions having improved properties in the section having the low aspect ratio. The method comprises providing a body of a lithium-containing aluminum alloy, extruding at least a low aspect ratio section from the body, the aspect ratio being in the range of 1 to 2.5, and maintaining the body in a temperature range of 400° to 1000° C. during said extrusion step. During the extruding process, the section of the body having the low aspect ratio should have at least a 4:1 extrusion reduction. The resulting extrusion section has a tensile yield strength of at least 60 ksi and having an ultimate yield strength of at least 4.5 ksi greater than the tensile yield strength.

BRIEF DESCRIPTION OF THE DRAWINGS

FIG. 1 is a cross section of an extrusion illustrating the invention having sections thereof having low and high aspect ratios wherein the properties of the low aspect ratio sections are improved in accordance with the invention.

FIG. 2 is a graph showing longitudinal tensile yield strength and the difference between ultimate yield strength and tensile yield strength.

DETAILED DESCRIPTION OF THE PREFERRED EMBODIMENTS

By low aspect ratio is meant a ratio in the range of 1 to 2.5. By high aspect ratio is meant a ratio greater than 2.5. By aspect ratio is meant the ratio of width to height, as shown in FIG. 1, for example. In a simple extrusion, e.g., an extrusion having a rectangular, square or circular cross section, the aspect ratio is the ratio of the width to the height of the extrusion. For extrusions having square or circular cross sections, the aspect ratio is one.

In extrusions having complex shapes, sections of the extrusion may have low aspect ratios, e.g., less than 2.5 (section A, FIG. 1) and other sections may have high aspect ratios, e.g., greater than 2.5 (section B, FIG. 1). The sections of the extrusions having low aspect ratios can have inferior properties compared to the section having high aspect ratios. The low aspect ratio section may have: (1) very high longitudinal tensile yield strengths, e.g., 90 ksi; (2) small difference between longitudinal tensile ultimate strength and tensile yield strength, e.g., 1.6 ksi or less; and (3) poor fracture toughness, e.g., less than 15 ksi vin. Such properties can exist even when the low aspect ratio section has undergone considerable work, e.g., even after an extrusion ratio of 7:1.

Aluminum-lithium alloys which may be provided as extrusions can contain 0.2 to 5.0 wt. % Li, 0 to 5.0 wt. % Mg, up to 6.5 wt. % Cu, 0 to 1.0 wt. % Zr, 0 to 2.0 wt. % Mn, 0.05 to 12.0 wt. % Zn, up to 2 wt. % Ag, 0.5 wt. % max. Fe, 0.5 wt. % max. Si, the balance aluminum and incidental elements and impurities. The impurities are preferably limited to about 0.05 wt. % each, and the combination of impurities preferably should not exceed 0.15 wt. %. Within these limits, it is preferred that the sum total of all impurities does not exceed 0.35 wt. %.

A preferred alloy in accordance with the present invention can contain 0.2 to 5.0 wt. % Li, at least 2.45 wt. % Cu, 0 to 1 wt. % Ag, 0.05 to 5.0 wt. % Mg, 0 to 1 wt. % Mn, 0.05 to 0.16 wt. % Zr, 0.05 to 12.0 wt. % Zn, the balance aluminum and incidental elements and impurities as specified above. A typical alloy composition would contain 1.5 to 3.0 wt. % Li, 2.55 to 2.90 wt. % Cu, 0.2 to 2.5 wt. % Mg, 0.2 to 11.0 wt. % Zn, 0 to 0.09 wt. % Zr, 0 to 1.0 wt. % Mn and max. 0.1 wt. % of each of Fe and Si. In a preferred typical alloy, Zn may be in the range of 0.2 to 2.0 and Mg 0.2 to 2.0 wt. %.

In the present invention, lithium is very important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density. It will be appreciated that less than 0.5 wt. % Li does not provide for significant reductions in the density of the alloy. It is not presently expected that higher levels of lithium would improve the combination of toughness and strength of the alloy product.

Typically, copper should be less than 3.0 wt. %; however, copper can be increased to 6.5 wt. % with low lithium additions, e.g., about 1%. The combination of lithium and copper should not exceed 7.5 wt. % with lithium being at least 1.0 wt. % with greater amounts of lithium being preferred. Thus, in accordance with this invention, it has been discovered that adhering to the ranges set forth above for copper, good fracture toughness, strength, corrosion and stress corrosion cracking resistance can be achieved.

Magnesium is added or provided in this class of aluminum alloys mainly for purposes of increasing strength although it does decrease density slightly and is advantageous from that standpoint. It is important to adhere to the upper limits set forth for magnesium because excess magnesium can also lead to interference with fracture toughness, particularly through the formation of undesirable phases at grain boundaries.

Zirconium is the preferred material for grain structure control; however, other materials which may be added can include at least one of Cr, V, Sc and Ti in the range of about 0.05 to 0.2 wt. % or at least one of Hf, Fe, Ni, Ag and Mn in the range of 0.05 to 0.6 wt. %. The level of Zr used depends on whether a recrystallized or unrecrystallized structure is desired. The use of zinc results in increased levels of strength, particularly in combination with magnesium. However, excessive amounts of zinc can impair toughness through the formation of intermetallic phases.

Zinc is important because, in this combination with magnesium, it results in an improved level of strength which is accompanied by high levels of corrosion resistance when compared to alloys which are zinc free. Particularly effective amounts of Zn are in the range of 0.1 to 1.0 wt. % when the magnesium is in the range of 0.05 to 0.5 wt. %, as presently understood. It is important to keep the Mg and Zn in a ratio in the range of about 0.1 to less than 1.0 when Mg is in the range of 0.1 to 1 wt. % with a preferred ratio being in the range of 0.2 to 0.9 and a typical ratio being in the range of about 0.3 to 0.8. The ratio of Mg to Zn can range from 1 to 6 when the wt. % of Mg is 1 to 4.0 and Zn is controlled to 0.2 to 2.0 wt. %, preferably in the range of 0.2 to 0.9 wt. %.

Working with the Mg/Zn ratio of less than one is important in that it aids in the worked product being less anisotropic or being more isotropic in nature, i.e., properties more uniform in all directions. That is, working with the Mg/Zn ratio in the range of 0.2 to 0.8 can result in the end product having greatly reduced hot worked texture, resulting from rolling, for example, to provide improved properties, for example in the 45° direction.

Silver additions aid in increased strength and fracture toughness by the formation of additional strengthening precipitates in the presence of Cu and/or Mg.

Toughness or fracture toughness as used herein refers to the resistance of a body, e.g. extrusions, sheet or plate, to the unstable growth of cracks or other flaws.

The Mg/Zn ratio less than one is important for another reason. That is, keeping the Mg/Zn ratio less than one, e.g., 0.5, results not only in greatly improved strength and fracture toughness but in greatly improved corrosion resistance. For example, when the Mg and Zn content is 0.5 wt. % each, the resistance to corrosion is greatly lowered. However, when the Mg content is about 0.3 wt. % and the Zn is 0.5 wt. %, the alloys have a high level of resistance to corrosion.

Other lithium-containing aluminum alloys which may be extruded to provide a product in accordance with the invention include Aluminum Association Alloy (AA) 2090, 2091, 2094, 2095, 8090, 8091, 8190, 2020, Weldalite, 1420, 1421, 01430, 01440 and 01450.

As well as providing the alloy product with controlled amounts of alloying elements as described hereinabove, the alloy is prepared according to specific method steps in order to provide the most desirable characteristics of the extrusion. Thus, the alloy as described herein can be provided as an ingot or billet for fabrication into a suitable extruded product by casting techniques currently employed in the art for cast products. It should be noted that the alloy may also be provided in billet form consolidated from fine particulate such as a powdered aluminum alloy having the compositions in the ranges set forth hereinabove. The powder or particulate material can be produced by processes such as atomization, mechanical alloying and melt spinning. The ingot or billet may be preliminarily worked or shaped to provide suitable stock for subsequent working operations. Prior to the principal working operation, the alloy stock is preferably subjected to homogenization, and preferably at metal temperatures in the range of 800° to 1050° F. for a period of time of at least one hour to dissolve soluble elements such as Li and Cu, and to homogenize the internal structure of the metal. A preferred time period is about 20 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable. In addition to dissolving constituent phases to promote workability, this homogenization treatment is important in that it aids precipitation of Mn and/or Zr-bearing dispersoids which help to control final grain structure.

After the homogenizing treatment, the ingot is first scalped and then extruded to produce extrusions.

When the ingot is comprised of the preferred alloy noted above, and Zn is maintained at less than 1 wt. %, typically 0.01–1 wt. % and Zr in the range of 0 to 0.1 wt. %, then preferably the ingot is heated in the temperature range of 500° to 1000° F., typically 500° to 800° F., and maintained in this range during the extruding process. Further, when the extrusion has sections therein having low aspect ratios, the low aspect ratio should be processed to provide an extrusion reduction of at least 4:1. The lowered Zr is believed to allow the low aspect ratio section to recover and/or recrystallize, and a lower extrusion temperature less than 800° F. is believed to increase the internal strain energy in the product, further promoting recovery and/or recrystallization.

After extruding the ingot to the desired shape, the extrusion is subjected to a solution heat treatment to dissolve soluble elements. The solution heat treatment is preferably accomplished at a temperature in the range of 900° to 1050° F. and preferably produces a recovered or recrystallized grain structure.

Solution heat treatment can be performed in batches. Basically, solution effects can occur fairly rapidly, for instance in as little as 30 to 60 seconds, once the metal has reached a solution temperature of about 900° to 1050° F. However, heating the metal to that temperature can involve substantial amounts of time depending on the type of operation involved. In batch treating in a production plant, the extrusions are treated in a furnace load and an amount of time can be required to bring the entire load to solution temperature, and accordingly, solution heat treating can consume one or more hours, for instance one or two hours or more in batch solution treating.

To further provide for the desired strengths necessary to the final product, the product should be rapidly quenched to prevent or minimize uncontrolled precipitation of strengthening phases.

The alloy product of the present invention may be artificially aged to provide the combination of fracture toughness and strength which are so highly desired in extrusion members of this type. This can be accomplished by subjecting the extrusion product to a temperature in the range of 150° to 400° F. for a sufficient period of time to further increase the yield strength. Some compositions of the alloy product are capable of being artificially aged to a yield strength higher than 95 ksi. Preferably, artificial aging is accomplished by subjecting the alloy product to a temperature in the range of 275° to 375° F. for a period of at least 30 minutes. A suitable aging practice contemplate a treatment of about 8 to 24 hours at a temperature of about 325° F. Further, it will be noted that the alloy product in accordance with the present invention may be subjected to any of the typical underaging treatments, including natural aging. Also, while reference has been made herein to single aging steps, multiple aging steps, such as two or three aging steps, are contemplated and may be used.

The product in accordance with the invention can be provided either in a recrystallized grain structure form or an unrecrystallized grain structure form, depending on the alloy and processing used.

While the ingot may be extruded in a one-step extrusion, two or even multiple steps are contemplated. Thus, in the first step, the ingot may be extruded to preliminarily work the ingot without extruding to shape. That is, a 16" diameter ingot may be first extruded to 9" diameter ingot before extruding to a final shape. Or, the ingot may be preliminarily shaped by a first extruding step and thereafter extruded to a final shape. Between the extruding steps, the preliminarily worked or shaped ingot may be subjected to a thermal treatment, prior to extruding to the final shape. The thermal treatment provides an intermediate anneal and is designed to minimize undesirable crystallographic texture. The thermal treatment can be in the temperature range of 400° to 1020° F., preferably 500° to 900° F., for a time period in the range of 8 to 24 hours. Usually, time in the temperature range is not needed to exceed 20 hours. In the first or preliminary working or extruding step, the amount of work should be at least 30% and preferably at least 40%.

If a recrystallized extrusion is desired, Zr is maintained at a low level, e.g., less than 0.1 wt. %, typically in the range of 0.1 to 0.08 Zr. Mn, Cr, Fe, Ni and V may be added in place of Zr to the ranges noted above. For example, in AA2090 or other lithium-containing alloys as noted above, Mn, Cr, Fe, Ni and V can be used in place of Zr so as to provide enhanced properties in the low aspect ratio sections.

Following these steps results in an extrusion with section thereof having low aspect ratios, yet exhibiting improved properties. That is, differences of at least 4.5 ksi can be achieved between tensile yield strength and ultimate tensile strengths.

If it is preferred to produce high aspect ratio extrusions, for example, in a wide integrally stiffened extruded panel, then the alloy should contain 0.5 to 3 wt. % Li, 2 to 7 wt. % Cu, 0.I to 2 wt. % Mg, 0.1 to 2 wt. % Ag, 0.1 to 2 wt. % of at least one of Mn, V, Cr, Hf, Ti, Ni and Fe. Mn is preferred in the range of about 0.1 to 1 wt. % with small additions of at least one of V, Cr, Hf, Ni and Fe. Also, Zn can be in the range of 0 to 12 wt. % in this alloy.

The following example is further illustrative of the invention:

EXAMPLE

An ingot 12"×38"×160" long was cast having the composition, in weight percent, 2.17 Li, 2.79 Cu, 0.25 Mg, 0.49 Zn, 0.07 Zr, 0.35 Mn and 0.08 V (referred to as Alloy A). The ingot was homogenized for 8 hours at 950° F. and 24 hours at 1000° F. and then machined to an extrusion billet 9" in diameter. For extruding, the billet was heated to about 900° F., and the extrusion cylinder was maintained at about the same temperature during extrusion. The billet was extruded to the shape shown in FIG. 1 at 4 inches per minute. The extrusion was solution heat treated for about 1 to 2 hours at about 1020° F., then cold water quenched and stretched about 6% of its original length. Thereafter, the extrusion was aged at 310° F. for 30 hours. Extrusion from aluminum-lithium alloys 2090, 2091 and 8090 were prepared in a similar manner. The results are given in Tables 1–4. From the Figures, it will be seen that the alloy of the invention has improved properties, as shown by the difference between ultimate tensile strength minus tensile yield strength plotted against longitudinal tensile yield strength.

TABLE 1

Comparison of Composition, Processing, and Properties of AA 8090, AA 2091, AA 2090 and Alloy of Invention (A) Formed Into Thick Section Extrusions

| Alloy/ Extrusion ID | Composition Li (%) | Cu (%) | Mg (%) | Zn (%) | Zr (%) | Mn (%) | V (%) |
|---|---|---|---|---|---|---|---|
| 2090/595159 | 2.07 | 2.76 | — | — | 0.100 | — | — |
| 2091/575595 | 2.06 | 2.24 | 1.54 | — | 0.090 | — | — |
| 8090/595252 | 2.14 | 1.06 | 0.65 | — | 0.115 | — | — |
| A/595276 | 2.17 | 2.79 | 0.25 | 0.49 | 0.074 | 0.35 | 0.08 |

TABLE 2

| Alloy/ Extrusion ID | Fabrication Billet Temp. (°F.) | Cylinder Temp (°F.) | Ram Speed (imp) |
|---|---|---|---|
| 2090/595159 | 905 | 901 | 4 |
| 2091/575595 | 750 | 766 | 4 |
| 8090/595252 | 800 | 798 | 4 |
| A/595276 | 750 | 753 | 4 |

TABLE 3

| Alloy/ Extrusion ID | Temper SHT | % Stretch | Age |
|---|---|---|---|
| 2090/595159 | 2 hrs. @ 1020° F. | 6 | 20 hrs. @ 325° F. |
| 2091/575595 | 1 hr. @ 990° F. | 6 | 24 hrs. @ 250° F. |
| 8090/595252 | 40 min. @ 1000° F. | 6 | 96 hrs. @ 300° F. |
| A/595276 | 1 hr. @ 1020° F. | 6 | 30 hrs. @ 310° F. |

TABLE 4

| Alloy/ Extrusion ID | Tensile Properties UTS L (ksi) | TYS L (ksi) | Elongation L (%) | UTS-YS L (ksi) |
|---|---|---|---|---|
| 2090/595159 | 92.6 | 91.3 | 6.0 | 1.3 |

TABLE 4-continued

| Alloy/ Extrusion ID | Tensile Properties UTS L (ksi) | TYS L (ksi) | Elongation L (%) | UTS-YS L (ksi) |
|---|---|---|---|---|
| 2091/575595 | 70 | 69.4 | 1.6 | 0.6 |
| 8090/595252 | 79.6 | 78.2 | 2.8 | 1.4 |
| A/595276 | 78 | 71.2 | 6.8 | 6.8 |

Having thus described the invention, what is claimed is:

1. A method of making lithium-containing aluminum base alloy extrusion having at least a section thereof having a low aspect ratio, the extrusions having improved properties in sections thereof having the low aspect ratio, the method comprising:

(a) providing a body of a lithium-containing aluminum alloy having about 0.05 to 1 wt. % Zn;

(b) extruding said body into an extrusion including a low aspect ratio section, the aspect ratio being in the range of 1 to 2.5; and (c) maintaining said body in a temperature range of 400° to 1000° F. and including for said low aspect ratio section at least a 4:1 extrusion reduction during said extrusion step, the low aspect ratio extrusion section having tensile yield strength of at least 60 ksi and having an ultimate yield strength of at least 4.5 ksi greater than the tensile yield strength.

2. The method in accordance with claim 1 wherein the extrusion has sections thereof having aspect ratios greater than 2.5.

3. The method in accordance with claim 1 wherein the body is maintained in a temperature range of 500° to 800° F.

4. The method in accordance with claim 1 wherein the alloy contains about 0.2 to 5.0 wt. % Li, 0 to 5.0 wt. % Mg, up to 6.5 wt. % Cu, 0 to 1.0 wt. % Zr, 0 to 2.0 wt. % Mn, 0.05 to 12.0 wt. % Zn, up to 2 wt. % Ag, 0.5 wt. % max. Fe, 0.5 wt. % max. Si, the balance aluminum and incidental elements and impurities.

5. The method in accordance with claim 1 wherein the alloy contains about 0.2 to 5.0 wt. % Li, at least 2.45 wt. % Cu, 0 to 1 wt. % Ag, 0.05 to 5.0 wt. % Mg, 0.05 to 0.16 wt. % Zr, 0.05 to 12.0 wt. % Zn, 0 to 1 wt. % Mn, the balance aluminum and incidental elements and impurities.

6. The method in accordance with claim 1 wherein the alloy contains about 1.5 to 3.0 wt. % Li, 2.55 to 2.90 wt. % Cu, 0.2 to 2.5 wt. % Mg, 0.2 to 11.0 wt. % Zn, 0.08 to 0.12 wt. % Zr, 0 to 1.0 wt. % Mn and max. 0.1 wt. % of each of Fe and Si.

7. The method in accordance with claim 1 wherein the alloy contains at least one of Cr, V, Sc and Ti in the range of about 0.05 to 0.2 wt. % or at least one of Hf, Fe, Ni, Ag and Mn in the range of 0.05 to 0.6 wt. %.

8. The method in accordance with claim 1 wherein the alloy is selected from AA2090, 2091, 2094, 2095, 8090, 8091, 8190, 1420, 1421 and 2020.

9. The method in accordance with claim 1 wherein the body is subjected to a preliminary shaping step to provide a preliminarily shaped body followed by further extruding operation to an extruded shape.

10. The method in accordance with claim 9 wherein the preliminarily shaped body is subjected to a thermal treatment in a temperature range of 400° to 1020° F.

11. The method in accordance with claim 10 wherein the thermal treatment is carried out in a time of 1 to 50 hours.

12. The method in accordance with claim 9 wherein in the preliminary shaping step, the body has a reduction in cross section of at least 30%.

13. A method of making lithium-containing aluminum base alloy extrusion having at least a section thereof having a low aspect ratio, the extrusion having improved properties in sections thereof having the low aspect ratio, the method comprising:

(a) providing a body of a lithium-containing aluminum alloy comprised of about 0.2 to 5.0 wt. % Li, 0 to 5.0 wt. % Mg, up to 6.0 wt. % Cu, 0 to 1.0 wt. % Zr, 0 to 2.0 wt. % Mn, 0.05 to 12.0 wt. % Zn, up to 2 wt. % Ag, 0.5 wt. % max. Fe, 0.5 wt. % max. Si, the balance aluminum and incidental elements and impurities;

(b) extruding said body to provide an extrusion having a section thereof having a low aspect ratio in the range of 1 to 2.5 and having a section having an aspect ratio of greater than 2.5; and (c) maintaining said body in a temperature range of 500° to 800° F. and providing at least a 4:1 extrusion reduction during said extrusion step in the section having the low aspect ratio, the extrusion section having the low aspect ratio having a tensile yield strength of at least 70 ksi and having an ultimate yield strength of at least 4.5 ksi greater than the tensile yield strength.

14. A method of making lithium-containing aluminum base alloy extrusion having at least a section thereof having a low aspect ratio, the extrusions having improved properties in sections thereof having the low aspect ratio, the method comprising:

(a) providing a body of a lithium-containing aluminum alloy;

(b) subjecting said body to a preliminary working operation to provide a preliminarily worked body;

(c) extruding said body to provide an extrusion having a section thereof having a low aspect ratio in the range of 1 to 2.5 and having a section having an aspect ratio of greater than 2.5; and (d) maintaining said preliminarily worked body in a temperature range of 500° to 800° F. and providing at least a 4:1 extrusion reduction during said extrusion step in the section having the low aspect ratio, the extrusion section having the low aspect ratio having a tensile yield strength of at least 70 ksi and having an ultimate yield strength of at least 4.5 ksi greater than the tensile yield strength.

15. The method in accordance with claim 14 wherein said worked body is subjected to a thermal treatment in the range of 500° to 1000° F.

16. A method of making lithium-containing aluminum base alloy extrusion having at least a section thereof having a low aspect ratio, the extrusions having improved properties in sections thereof having the low aspect ratio, the method comprising:

(a) providing a body of a lithium-containing aluminum alloy comprised of about 0.2 to 5.0 wt. % Li, 0 to 5.0 wt. % Mg, up to 6.0 wt. % Cu, 0 to 1.0 wt. % Zr, 0 to 2.0 wt. % Mn, 0.05 to 12.0 wt. % Zn, up to 2 wt. % Ag, 0.5 wt. % max. Fe, 0.5 wt. % max. Si, the balance aluminum and incidental elements and impurities;

(b) subjecting said body to a first extruding operation to provide a preliminarily worked body;

(c) annealing said preliminarily worked body in a temperature range of 500° to 1000° F.;

(d) further extruding said worked body to provide an extrusion having a section thereof having a low aspect ratio in the range of 1 to 2.5 and having a section having an aspect ratio of greater than 2.5; and (e) maintaining said preliminarily worked body in a temperature range of 400° to 1000° F. and providing at least a 4:1 extrusion reduction during said extrusion step in the section having the low aspect ratio, the extrusion section having the low aspect ratio having a tensile yield strength of at least 70 ksi and having an ultimate yield strength of at least 4.5 ksi greater than the tensile yield strength.

17. The method in accordance with claim 16 wherein the alloy contains 0.2 to 5.0 wt. % Li, at least 2.45 wt. % Cu, 0.05 to 5.0 wt. % Mg, 0.05 to 0.16 wt. % Zr, 0.05 to 12.0 wt. % Zn, 0 to 1 wt. % Mn, the balance aluminum and incidental elements and impurities.

18. The method in accordance with claim 16 wherein the alloy contains 1.5 to 3.0 wt. % Li, 2.55 to 2.90 wt. % Cu, 0.2 to 2.5 wt. % Mg, 0.2 to 11.0 wt. % Zn, 0.08 to 0.12 wt. % Zr, 0 to 1.0 wt. % Mn and max. 0.1 wt. % of each of Fe and Si.

19. A lithium-containing aluminum alloy extrusion having a section thereof having a low aspect ratio and another section thereof having a high aspect ratio, the extrusion having improved properties in the low aspect ratio section, the extrusion comprised of a lithium-containing alloy having 0.05 to 1 wt. % Zn, the low aspect ratio being in the range of 1 to 2.5, the extrusion having the low aspect ratio having a tensile yield strength of at least 60 ksi and having an ultimate yield strength of 4.5 ksi greater than the tensile yield strength.

* * * * *